US012679608B2

(12) United States Patent
Crawford et al.

(10) Patent No.: US 12,679,608 B2
(45) Date of Patent: Jul. 14, 2026

(54) CONTAINER CLOSURE DEVICE AND METHOD OF OPERATING THE SAME

(71) Applicant: ATKINS NUCLEAR SECURED HOLDINGS CORPORATION, Oak Ridge, TN (US)

(72) Inventors: Gordon Crawford, Oak Ridge, TN (US); John Richardson, Oak Ridge, TN (US)

(73) Assignee: Atkins Nuclear Secured Holdings Corporation, Oak Ridge, TN (US)

( * ) Notice: Subject to any disclaimer, the term of this patent is extended or adjusted under 35 U.S.C. 154(b) by 104 days.

(21) Appl. No.: 17/997,458

(22) PCT Filed: Apr. 28, 2021

(86) PCT No.: PCT/US2021/029701
§ 371 (c)(1),
(2) Date: Oct. 28, 2022

(87) PCT Pub. No.: WO2021/222444
PCT Pub. Date: Nov. 4, 2021

(65) Prior Publication Data
US 2023/0219722 A1 Jul. 13, 2023

Related U.S. Application Data

(60) Provisional application No. 63/016,652, filed on Apr. 28, 2020.

(51) Int. Cl.
*B65D 45/32* (2006.01)
*E05B 65/00* (2006.01)

(52) U.S. Cl.
CPC ..... *B65D 45/32* (2013.01)

(58) Field of Classification Search
CPC ... B65D 45/32; Y10T 292/20; Y10T 292/205; Y10T 292/212; Y10T 292/214;
(Continued)

(56) References Cited

U.S. PATENT DOCUMENTS 2,461,908 A * 2/1949 Magnesen ..... B65D 45/30 206/508
2,686,624 A * 8/1954 Podesta ..... B65B 7/28 53/341
(Continued)

FOREIGN PATENT DOCUMENTS

EP 0688020 A1 * 12/1995
EP 0806345 A1 * 11/1997
(Continued)

OTHER PUBLICATIONS

PCT International Search Report and Written Opinion issued in International Application No. PCT/US2021/029701, dated Sep. 15, 2021.
(Continued)

*Primary Examiner* — Carlos Lugo
(74) *Attorney, Agent, or Firm* — Norton Rose Fulbright US LLP

(57) ABSTRACT

A lid assembly and a method for assembling the lid assembly. The lid assembly may include: an open-loop clamp band configured to secure the container lid to a container opening, the open-loop clamp band biased towards a closed position; and a closure assembly coupled to the open-loop clamp band. The closure assembly may include: a pair of lugs including a threaded lug and an unthreaded lug respectively affixed to opposing ends of the open-loop clamp band; a clamp bolt receivable by the pair of lugs, the clamp bolt having a bolt head to be positioned proximal the unthreaded lug; and a jam assembly for receiving the clamp bolt, the jam
(Continued)

assembly securable at a calibrated position along the clamp bolt and between the pair of lugs.

18 Claims, 9 Drawing Sheets

(58) Field of Classification Search
CPC ..... Y10T 29/53322; Y10T 29/49936; Y10T 29/49948; E05B 65/006
USPC ..... 220/319, 320
See application file for complete search history.

(56) References Cited

U.S. PATENT DOCUMENTS 2,807,451 A * 9/1957 Kuhni ..... B01D 3/328 285/298
3,352,450 A * 11/1967 Rawlins ..... B44D 3/128 220/571.1
3,721,363 A * 3/1973 Bressler ..... F16J 13/06 220/849
4,134,609 A 1/1979 Santoni
4,987,671 A * 1/1991 Clausen-Schaumann ..... B60J 7/022 296/216.02
5,016,931 A * 5/1991 Jackson ..... E05B 15/025 411/7
5,193,864 A * 3/1993 Coleman ..... F16B 2/08 292/256.67
5,271,518 A * 12/1993 Webb ..... F15B 1/26 220/373
5,584,410 A * 12/1996 Siblik ..... B65D 45/32 411/146
5,971,190 A 10/1999 Mannino
6,435,576 B1 * 8/2002 Kusta ..... B65D 45/32 292/256.65
7,055,810 B2 * 6/2006 Gage ..... B01D 3/328 261/114.5
2005/0109783 A1 5/2005 Smith
2006/0163255 A1 * 7/2006 Boyd ..... B65D 45/32 215/276
2013/0064624 A1 3/2013 Lee et al.

FOREIGN PATENT DOCUMENTS

FR 2545790 A1 * 11/1984
JP S 38-261 Y 1/1963
KR 102118867 B1 * 6/2020

OTHER PUBLICATIONS

English translation of Office Communication issued in Japanese Patent Application No. 2022-565885, dated Jun. 10, 2025.

* cited by examiner

CONTAINER CLOSURE DEVICE AND METHOD OF OPERATING THE SAME

CROSS REFERENCE TO RELATED APPLICATIONS

This application is a national phase application under 35 U.S.C. § 371 of International Application No. PCT/US2021/029701, filed Apr. 28, 2021, which claims priority from U.S. Provisional Patent Application No. 63/016,652, entitled "CONTAINER CLOSURE DEVICE AND METHOD OF OPERATING THE SAME", filed on Apr. 28, 2020, the entire contents of each of which are hereby incorporated by reference herein.

FIELD OF THE INVENTION

The present disclosure generally relates to containers, and in particular to container closure devices and methods of operating the container closure devices.

BACKGROUND OF THE INVENTION

Substances which may be hazardous or to which exposure should be minimized, such as nuclear waste or toxic substances, may be in solid form, liquid form, or a combination thereof. Containers may be configured to isolate, store, or transport the substances. In some examples, containers may be configured to receive substances and to mix the substances with immobilization reagents to produce a solidified matrix, thereby reducing likelihood that the substances received within the container may leak or leach into the environment. In some other examples, containers may be sealed by securing a container lid at the container opening for preventing substances from leaking into the environment.

SUMMARY OF THE INVENTION

Embodiments described in the present disclosure provide lid assemblies for container lids. In some embodiments, lid assemblies may include features based on prior-certified closure devices, and such closure devices may be enhanced with features adapted to allow a technician to seal containers while physically positioned a distance away from the container.

In some scenarios, technicians may iteratively strike a perimeter of a container lid at an interface between the container opening and the container lid for increasing integrity of a seal at the interface. Such operations may increase occurrences of hazardous substances splashing out of the container, thereby potentially exposing the technician to the hazardous substances. Embodiments described in the present disclosure provide devices adaptable for remotely applying a downward force to the container lid for sealing the container. In some scenarios, devices adaptable for applying downward force on the container lid may increase integrity of the seal between the container lid and the container opening.

In some scenarios, once a container and associated closure devices receive certification or regulatory approval, modifications to the container or associated closure devices may, in some scenarios, invalidate the certification. Some embodiments of the present disclosure include features that may allow remote operation of the container closure devices and that may avoid invalidation of prior certification or regulatory approvals.

In one aspect, the present disclosure provides a lid assembly for a container lid. The lid assembly may include: an open-loop clamp band configured to secure the container lid to a container opening, the open-loop clamp band biased towards a closed position and a closure assembly coupled to the open-loop clamp band. The closure assembly may include: a pair of lugs including a threaded lug and an unthreaded lug respectively affixed to opposing ends of the open-loop clamp band; a clamp bolt receivable by the pair of lugs, the clamp bolt having a bolt head to be positioned proximal the unthreaded lug; and a jam assembly for receiving the clamp bolt, the jam assembly securable at a calibrated position along the clamp bolt and between the pair of lugs.

In some embodiments, the clamp bolt may be rotatable for transitioning the open-loop clamp band between an open position and the closed position.

In any of the above embodiments, the jam assembly may include a pair of jam nuts respectively torqued towards the other of the pair of jam nuts to secure the jam assembly at the calibrated position along the clamp bolt.

In any of the above embodiments, the open-loop clamp band may be a clamp ring for fitting around a substantially circular drum lid.

In any of the above embodiments, the lid assembly may include a standoff device for positioning between the unthreaded lug and the jam assembly for maintaining a position of the bolt head relative to the unthreaded lug.

In some embodiments, the standoff device may include a cotter pin received within an aperture in a shaft of the clamp bolt, the aperture positioned on an opposing side of the unthreaded lug relative to the bolt head.

In some embodiments, the standoff device may include at least one of a Belleville washer or a wedge device.

In any of the above embodiments, the lid assembly may include an annular weight for overlaying a region proximal to a perimeter of the container lid to impart a downward sealing force at an interface between the container lid and the container opening.

In some embodiments, the annular weight may include an electromagnet or suction device configured to engage the container lid for placing or removing the container lid at the container opening.

In some embodiments, the lid assembly may include a drip tray for receiving excess substance from a container fill head.

In some embodiments, the drip tray and the annular weight may be configured to be substantially concentric with one another.

In another aspect, the present disclosure provides a lid assembly for a container lid. The lid assembly may include: an open-loop clamp band configured to secure the container lid to a container opening; a closure assembly coupled to the open-loop clamp band; and an annular weight for overlaying a region proximal to a perimeter of the container lid to impart a downward sealing force at an interface between the container lid and a container opening.

In some embodiments, the container lid may be substantially circular, and the annular weight may impart a downward sealing force over a radially outward portion of the container lid.

In some embodiments, the annular weight may include a plurality of wedge-shaped alignment fingers configured to concentrically align the annular weight with the container lid.

In any of the above embodiments, the lid assembly may include an electromagnet or suction device adapted to lift the container lid onto or from the container rim.

In any of the above embodiments, the annular weight may be configured as a drip tray for receiving excess substance from a container fill head.

In any of the above embodiments, the lid assembly may include a drip tray for receiving excess substance from a container fill head, wherein the drip tray and the annular weight are configured to be positioned concentric with the annular weight.

In any of the above embodiments, the open-loop clamp band may be a clamp ring for fitting around a substantially circular drum lid.

In any of the above embodiments, the closure assembly may include: a pair of lugs including a threaded lug and an unthreaded lug respectively affixed to opposing ends of the open-loop clamp band; a clamp bolt receivable by the pair of lugs, the clamp bolt having a bolt head to be positioned proximal the unthreaded lug; and a jam assembly for receiving the clamp bolt, the jam assembly securable at a calibrated position along the clamp bolt and between the pair of lugs.

In some embodiments, the clamp bolt may be rotatable for transitioning the open-loop clamp band between an open position and the closed position.

In any of the above embodiments, the jam assembly may include a pair of jam nuts respectively torqued towards the other of the pair of jam nuts to secure the jam assembly at the calibrated position along the clamp bolt.

In any of the above embodiments, the lid assembly may include a standoff device for positioning between the unthreaded lug and the jam assembly for maintaining a position of the bolt head relative to the unthreaded lug while the open-loop clamp band is biased towards the closed position.

In some embodiments, the standoff device may include a cotter pin received within an aperture in a shaft of the clamp bolt, the aperture positioned on an opposing side of the unthreaded lug relative to the bolt head.

In some embodiments, wherein the standoff device may include at least one of a Belleville washer or a wedge device.

In any of the above embodiments, the lid assembly may include an electromagnet or suction device configured to engage the container lid for placing or removing the container lid at the container opening.

In any of the above embodiments, the lid assembly may include a drip tray for receiving excess substance from a container fill head.

In some embodiments, the drip tray and the annular weight may be configured to be substantially concentric with one another.

In another aspect, the present disclosure provides a method of assembling a lid assembly for a container lid. The method may include: extending a clamp bolt through an unthreaded lug, the unthreaded lug affixed to a first open end of an open-loop clamp band; engaging the clamp bolt with a jam assembly; threading the clamp bolt into a threaded lug, the threaded lug affixed to a second open end of the open-loop clamp band; and affixing the jam assembly at a calibrated position along the clamp bolt, the jam assembly positioned between the threaded lug and the unthreaded lug.

In some embodiments, the jam assembly may include a pair of jam nuts, and engaging the clamp bolt with the jam assembly may include torqueing each of the jam nuts towards the other of the pair of jam nuts to secure the assembly at the calibrated position along the clamp bolt.

In any of the above embodiments, the method may include securing a standoff device between the unthreaded lug and the jam assembly to maintain a position of the bolt head relative to the unthreaded lug.

In some embodiments, the standoff device may include a cotter pin, and securing the standoff device may include: drilling an aperture in a shaft of the clamp bolt at a position between the affixed jam assembly and the unthreaded lug; and inserting the cotter pin within the drilled aperture for positioning the pin between the jam assembly and the unthreaded lug.

In any of the above embodiments, the method may include rotating the clamp bolt head in a direction to unthread the clamp bolt from the threaded lug to position the open-loop clamp band in an open position.

In this respect, before explaining at least one embodiment in detail, it is to be understood that the embodiments are not limited in application to the details of construction and to the arrangements of the components set forth in the following description or illustrated in the drawings. Also, it is to be understood that the phraseology and terminology employed herein are for the purpose of description and should not be regarded as limiting.

Many further features and combinations thereof concerning embodiments described herein will appear to those skilled in the art following a reading of the present disclosure.

BRIEF DESCRIPTION OF THE DRAWINGS

In the figures, embodiments are illustrated by way of example. It is to be expressly understood that the description and figures are only for the purpose of illustration and as an aid to understanding.

Embodiments will now be described, by way of example only, with reference to the attached figures, wherein in the figures.

DETAILED DESCRIPTION

Figure 1B:
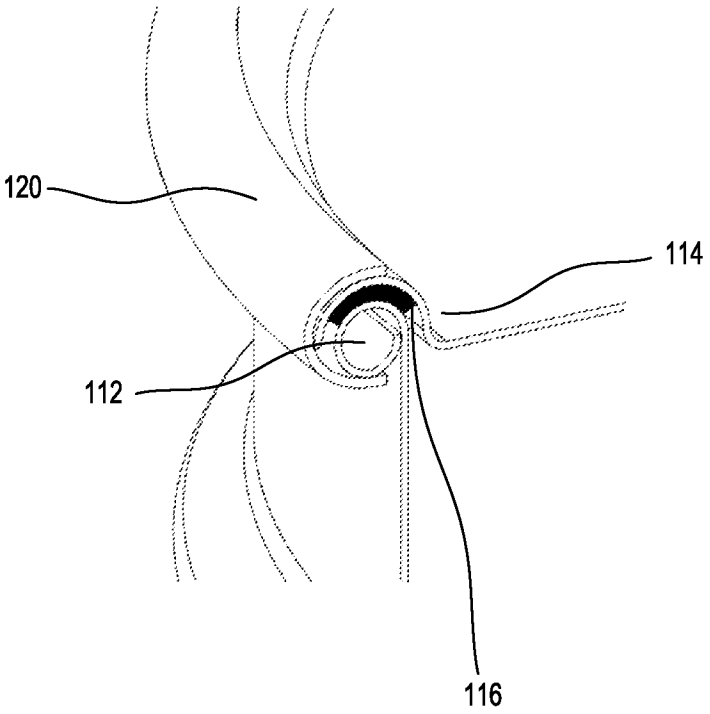
FIG. 1B illustrates an enlarged, cutaway view of the container illustrated in FIG. 1A.

Containers may be configured for receiving materials to be stored or transported. For example, drums or other container types may be adapted to store or transport materials. Technicians may conduct manual operations for reducing the chance that contaminants breach a seal between a container and a container lid. In examples when materials within the container may not be hazardous to the environment or to humans, there may be reduced concerns associated with safety of a technician conducting operations for sealing or unsealing containers.

In some scenarios, containers may be adapted to store or transport hazardous materials, such as substances that may be harmful to the environment or to persons. Hazardous substances may include substances that may cause illness to humans or cause undesired changes to the environment, such as ionizing radioactive materials, among other examples. In some scenarios, containers storing hazardous substances may exceed contact handling limits, such as 0.2 Roentgen Equivalent Man per hour (Rem/hr). It may be beneficial to provide container closure devices that may be remotely operated. By remotely operating closure devices adapted to seal containers for storing or transporting hazardous materials, risks associated with technicians contacting the hazardous materials may be reduced.

Methods for encapsulating hazardous substances within containers may include securing a container lid to an opening or rim of the container. In some scenarios, a technician may place a container lid at the container opening and may apply a force to the container lid for providing a seal at the interface between a perimeter of the container lid and a rim of the container. The technician may apply downward force to the container lid with a mallet or other striking device. However, striking the container lid may cause hazardous substances to splash out of the container, thereby potentially exposing the technician to the hazardous substance. It may be beneficial to provide devices adaptable for remotely applying a downward force to the container lid for sealing the container. In some scenarios, it may be beneficial to provide devices to provide a substantially similar downward force about the perimeter of the container lid, thereby increasing integrity of the seal between the container lid and the container opening.

In some scenarios, to utilize a container for receiving, storing, or transporting hazardous substances, some regulatory agencies may require that the container and closure devices be subjected to one or more certification tests. For example, to be approved for transportation on publically accessible roadways in some jurisdictions/countries, containers for receiving hazardous substances may need to comply with certification requirements, such as drop test requirements, water penetration test requirements, or the like. Such certification standards may be associated with ensuring that the containers may not be breached or damaged based on a set of test criteria. In some scenarios, obtaining regulatory approval or certification may be a laborious process, and may be time consuming or costly.

Once a container and associated closure devices receive certification or regulatory approval, modifications to the container or associated closure devices may, in some scenarios, invalidate the certification. It may be beneficial to provide enhancements to container closure devices that may not invalidate prior certification or regulatory approvals.

Embodiments described in the present disclosure include lid assemblies for container lids. In some embodiments, lid assemblies may include features based on prior-certified closure devices, and such closure devices may be enhanced with features that are adapted to allow a technician to seal containers while physically positioned a relatively greater distance away from the container. In some embodiments, lid assemblies may include devices for overlaying an annular weight device at a region proximal to a perimeter of a container lid. The annular weight device may impart a downward sealing force at an interface between the container lid and the container opening, such that a technician may be physically positioned at a relatively greater distance away from the container.

By increasing the distance between a technician and containers storing hazardous substances and by minimizing duration of time that a technician may need to be physically proximal to such containers, the technician may reduce their exposure to hazardous substances.

Embodiments of the present disclosure may be described with reference to generally cylindrical containers (e.g., commercially available 30 or 55 gallon drums) to isolate, store, or transport waste materials. It may be appreciated that other container types, shapes, or sizes may be used. For example, containers for receiving, storing, or transporting hazardous substances may have other non-circular cross-sectional shapes.

Figure 1A:
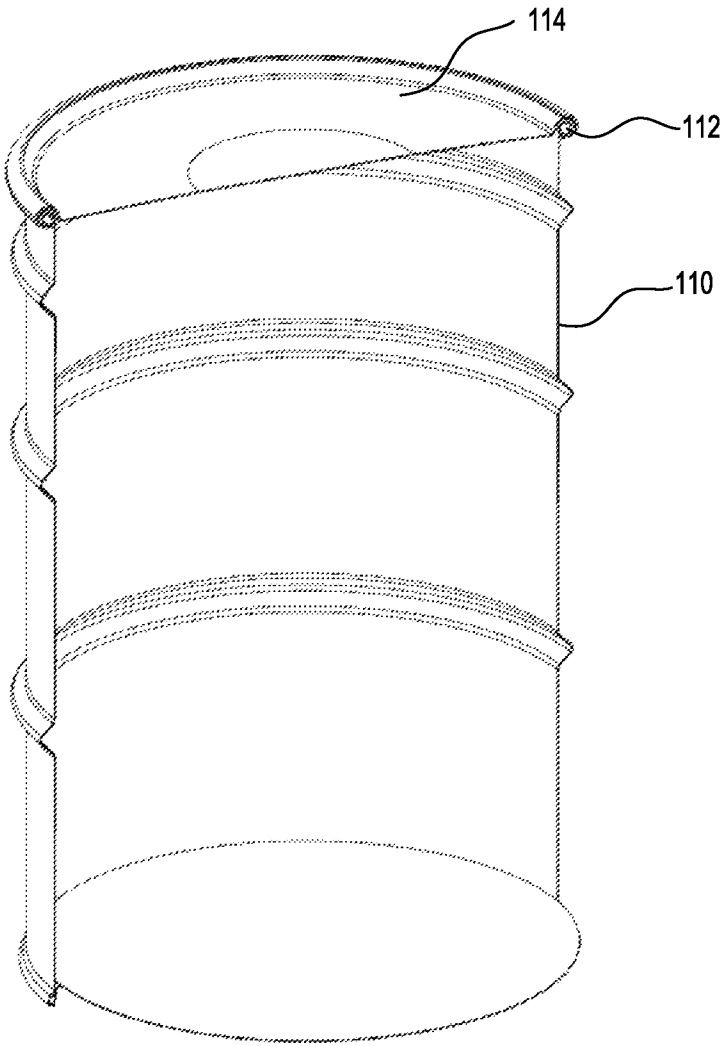
FIG. 1A illustrates a cutaway, perspective view of a container.

Reference is made to FIG. 1A, which illustrates a cutaway, perspective view of a container 110, in accordance with embodiments of the present disclosure. The container 110 may be generally cylindrical in shape. For example, the container 110 may be a 55-gallon container or drum. Other container sizes and container shapes may be used. In some embodiments, devices for interacting with substances received therein may be placed within the drum. Such devices may include mixing paddles, or other apparatus.

In some embodiments, the container 110 may include a container lid 114 installed at an opening of the container 110. The container lid 114 may be adapted to seal the container 110, such that substances received within the container 110 may be isolated from the external environment.

The container 110 may have an opening with a rolled upper rim 112 or curl. The rolled upper rim 112 may be complementary to a perimeter of the container lid 114

Reference is made to FIG. 1B, which illustrates an enlarged, partial cutaway view of the container 110 illustrated in FIG. 1A. In some embodiments, a gasket 116 may be positioned between the rolled upper rim 112 and the perimeter of the lid 114. When the lid 114 is installed at the opening of the container 110, the gasket 116 may provide a seal to prevent seepage or passage of waste materials to the environment external to the container. In some embodiments, the gasket 116 may be constructed of rubber. Other types of materials for the gasket 116 may be used.

In some embodiments, an open-loop clamp band may be configured to secure the container lid to the opening of the container 110. For example, the open-loop clamp band may be a clamp ring 120 adapted to wrap around a combination of a region proximal a perimeter of the container lid 114 and the rolled upper rim 112 of the container 110. When the clamp ring 120 is tightened around the perimeter of the container lid 114, the clamp ring may compress the gasket 116 and may provide a seal at the interface between the container lid 114 and the container opening.

In FIG. 1, the rolled upper rim 112 of the container and the perimeter of the container lid 114 are illustrated as convex interface surfaces. In some other embodiments, the interface between the container lid 114 and the container opening may respectively be concave surfaces, and the open-loop clamp band may be configured to wrap around such a combination of a container lid perimeter and container rim having a concave profile, and may abut the container rather than the container lid.

Figure 2:
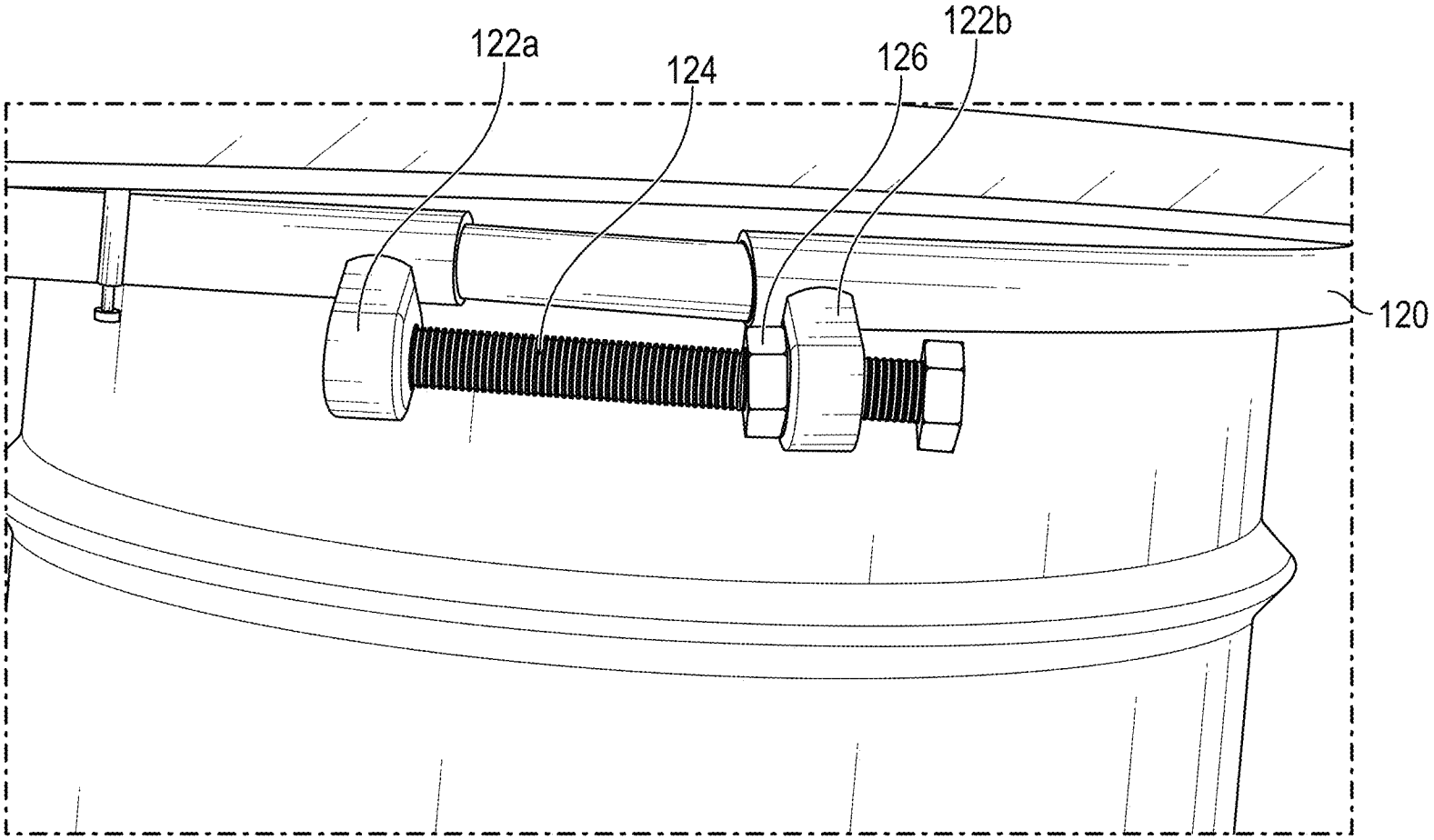
FIG. 2 illustrates a clamp ring and a closure assembly, in accordance with an embodiment of the present disclosure.

Reference is made to FIG. 2, which illustrates a clamp ring 120 and a closure assembly. The clamp ring 120 may be configured to wrap around a container lid for securing or affixing the container lid to the container of FIG. 1. In some embodiments, the clamp ring 120 may be an open-loop clamp band. For example, the clamp ring 120 may a substantially circular ring having an opening with two open ends.

The clamp ring 120 may include a closure assembly coupled to the clamp ring 120. When the container lid is installed at the container opening and when the clamp ring 120 is wrapped around the container lid, the closure assembly may be configured to tighten the clamp ring around a perimeter of the container lid. When the clamp ring 120 is tightened to secure the container lid to the container opening, the clamp ring 120 may be in a closed position. When tightened, the clamp ring may compress a gasket (not explicitly shown in FIG. 2) for sealing the container.

The closure assembly may be coupled to an open portion of the clamp ring 120. The closure assembly may include a threaded lug 122*a* and an unthreaded lug 122*b*. The threaded lug 122*a* and the unthreaded lug 122*b* may receive a clamp bolt 124. The clamp bolt may be tangentially positioned relative to the clamp ring 120. FIG. 2 illustrates the clamp ring 120 in an open or untightened position.

When the clamp bolt 124 is rotated in a clock-wise direction, a bolt head of the clamp bolt 124 may advance the unthreaded lug 122*b* towards the threaded lug 122*a* to tighten the clamp ring 120 around the container lid In the example of FIG. 2, a single lock nut 126 is positioned between the threaded lug 122*a* and the unthreaded lug 122*b*. The single lock nut 126 may receive the clamp bolt 124. Once the clamp bolt 124 is rotated to tighten the clamp ring 120 around the container lid, the single lock nut 126 may be rotatably adjusted along the clamp bolt 124 and towards the unthreaded lug 122*b*.

During transportation of a sealed container, the container may be subject to vibrations, or similar impact movements. The single lock nut 126 may be tightened to abut the threaded lug 122*b*. Tightening the single lock nut 126 to abut the unthreaded lug 122*b* may reduce movement of the clamp bolt relative to the unthreaded lug when the sealed container is transported.

In the present example, a technician conducting operations to tighten the example clamp ring 120 and closure assembly described with reference to FIG. 2 may be required to iteratively rotate the single lock nut 126 along the clamp bolt 124 and towards the threaded lug 122*a* while rotating the clamp bolt 124 at least because the unthreaded lug 122*b* may bias towards and press up against the single lock nut 126. The unthreaded lug 122*b* may press up against the single lock nut 126 at least because the clamp ring 120 may be constructed to bias towards a closed position. For example, the clamp ring 120 in a closed position may have a ring diameter that is smaller than a ring diameter of the clamp ring 120 in an open position. In another example, when the clamp ring 120 is in a closed position, a distance between the threaded lug 122*a* and the unthreaded lug 122*b* may be smaller than a distance between the threaded lug 122*a* and the unthreaded lug 122*b* when the clamp ring 120 is in an open position.

In the example described with reference to FIG. 2, a technician may need to iteratively or successively rotate the single lock nut 126 (using a wrench) and the clamp bolt 124 to tighten the clamp ring 120 around a perimeter of the container lid, it may be challenging to remotely conduct operations to seal the container. Because the technician may need to be physically near the container: (i) to seat the clamp ring 120 around the combination of the container lid and the rim of the container opening; and/or (ii) to tighten the clamp ring 120 illustrated in FIG. 2 for sealing the container, conducting such operations may increase the amount of time the technician may be exposed to or proximal to the container. This may hinder the ability of the technician to reduce physical exposure to hazardous materials that may be within the container. It may be beneficial to provide closure devices and methods of operating closure devices that reduce the amount of time or the requirement for a technician to be in close physical contact with the target container being sealed.

In some scenarios, a technician may utilize a rubber mallet, or similar instrument, to iteratively strike the perimeter of the container lid against the upper rim 112 (FIG. 1) of the container for reducing uneven tensioning of the clamp ring 120 relative to the container and container lid. In some scenarios, the technician may strike the clamp ring 120 for subjecting substantially similar downward force at multiple locations around the clamp ring for sealing the container.

Further, as the clamp ring 120 may be bent into an unintended positions (e.g., circumferential portion of the clamp ring may not lie in a single or horizontal plane), the technician may strike portions of the clamp ring 120 to position the claim ring 220 into position at the interface between the container opening and the container lid.

Striking the perimeter of the container lid and/or the clamp ring may, however, promote hazardous substance within the container to splash towards the container opening. Accordingly, by striking the perimeter of the container lid for increasing the integrity of the seal at the interface between the container lid and the container opening, the technician may increase the risk of splashing such hazardous substances onto themselves. It may be beneficial to provide devices for imparting a downward sealing force at an interface between the container lid and the container opening whilst reducing chances of exposing a technician to hazardous substances stored within the container.

Figure 3:
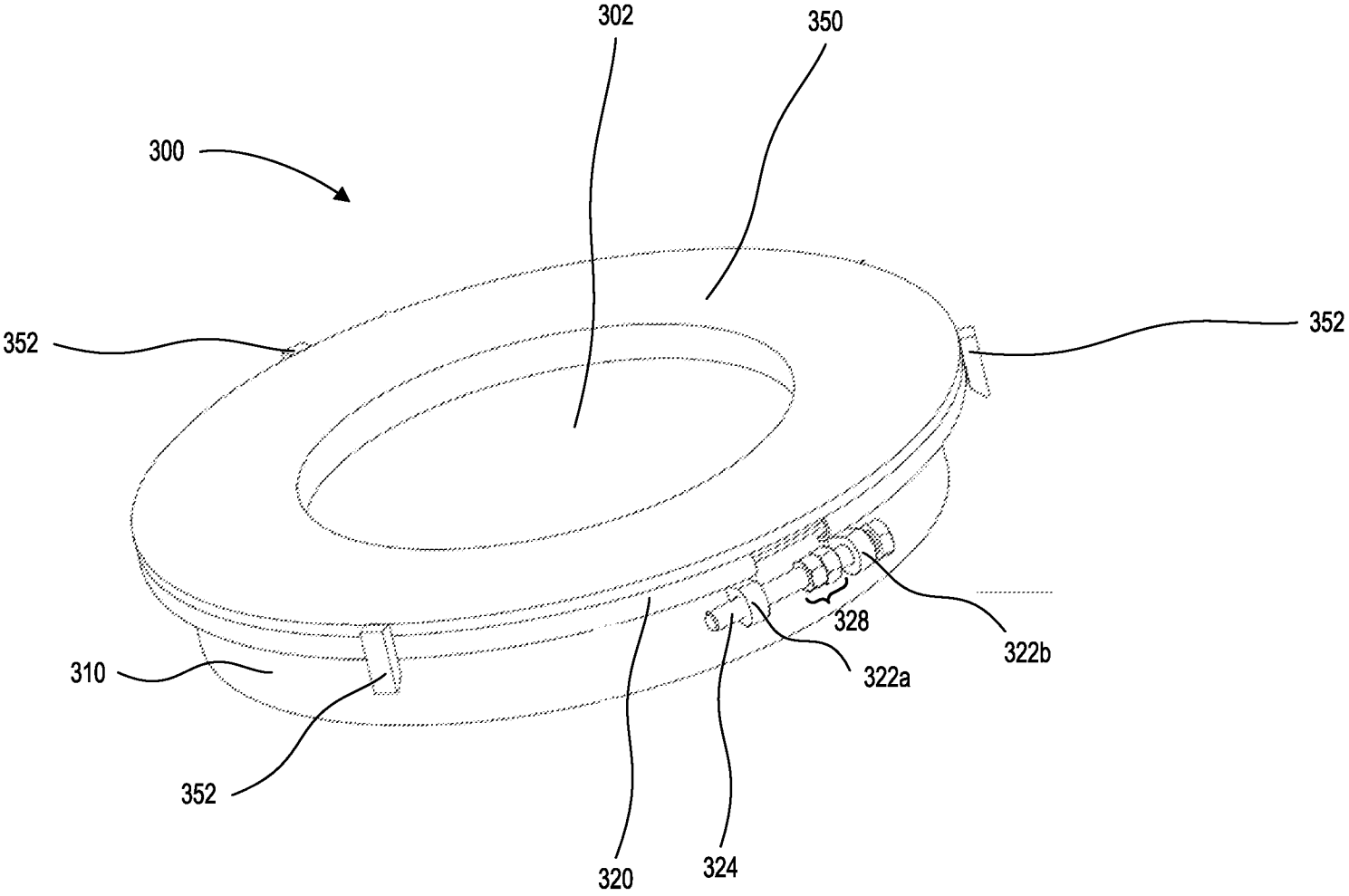
FIG. 3 illustrates a perspective view of a lid assembly, in accordance with an embodiment of the present disclosure.

Reference is made to FIG. 3, which illustrates a perspective view of a lid assembly 300, in accordance with an embodiment of the present disclosure. The lid assembly 300 may be installed at an opening of a container 310.

In some embodiments, the container 310 may be a cylindrical drum and the opening of the container 310 may be substantially circular. The lid assembly 300 illustrated in FIG. 3 may be configured to be installed at the circular opening of the container 310.

The container lid 302 may have a perimeter complementary to the opening of the container 310. For example, the container lid 302 may be circular and may have a diameter substantially similar to the diameter of the opening of the container 310.

The lid assembly 300 may include an annular weight 350 for overlaying a region proximal to a perimeter of the container lid 302. For example, the annular weight 350 may be removably positioned atop container lid 302. When overlaid on the container lid 302, the annular weight 350 may be concentric with the container lid 302 (e.g., share a substantially similar center point).

The annular weight 350 may be positioned adjacent an outer surface of the container lid 302. In some embodiments, the annular weight 350 may be ring-shaped or donut-shaped, and may be configured to apply a downward force to the container lid 302 or the clamp ring 320 during operations to close or maintain a seal to the container 310.

The annular weight 350 may be shaped to maintain a downward sealing force on a gasket installed between the container lid 302 and the opening of the container 310. For example, when the annular weight 350 is positioned adjacent the outer surface of the container lid 302, the annular weight 350 may apply pressure to the gasket. Subsequently, a technician may conduct operations for transitioning the clamp ring 320 to a closed position. While the annular weight 350 is positioned on the container lid 302, the compression force on the container lid 302 reduces occurrences of liquid or solids passing through the gap between the container lid 302 and the container opening.

Further, when the annular weight 350 is positioned adjacent the outer surface of the container lid 302, the annular weight 350 may be positioned to maintain concentricity between the container lid 302 and the clamp ring 320 whilst the clamp ring 320 is tightened around the container lid 302. Accordingly, the annular weight 350 may be configured to maintain the clamp ring 320 in a substantially circular shape in a horizontal plane during operations for removing or attaching the lid from or to the opening of the container 310.

In some embodiments, the annular weight 350 may include a plurality of alignment fingers 352. In some embodiments, the alignment fingers 352 may be wedge-shaped. The alignment fingers 352 may be distributed about the circumference of the annular weight 350.

For example, the annular weight 350 illustrated in FIG. 3 includes three alignment fingers 352 distributed at spaced apart positions about the outer edge of the annular weight. Although three alignment fingers 352 are illustrated in FIG. 3, any number of alignment fingers 352 to assist with positioning the annular weight 350 adjacent the container lid 302 and maintaining the position of the annular weight 350 adjacent the container lid 302 may be used.

In some scenarios, when the annular weight 350 is lowered to be overlaid atop the container lid 302, the wedge-shaped structure of the alignment fingers 352 may assist with aligning the annular ring 350 and the container lid 302.

In some embodiments, the clamp ring 320 may be an open-ended clamp band. The open-ended clamp band may have a closed position and an open position. When the clamp ring 320 is in a closed position, the diameter of the clamp ring 320 may be smaller as compared to when the clamp ring 320 is in an open position. When the clamp ring 320 is in an open position, the clamp ring 320 may be installed to secure the container lid 302 to the container opening.

The clamp ring 320 may be configured to tighten around the perimeter of the container lid 302 when sealing the container 310. The clamp ring 320 may be configured to be loosened from the perimeter of the container lid 302 when un-sealing the container 310 or when a technician removes the container lid 302 from the container 310.

The lid assembly 300 may include a closure assembly coupled to the open portion of the clamp ring 320. The closure assembly may include a pair of lugs, including a threaded lug 322*a* and an unthreaded lug 322*b*. The threaded lug 322*a* and the unthreaded lug 322*b* may be respectively affixed to opposing ends of the open-loop clamp band.

A clamp bolt 324 may be receivable by the threaded lug 322*a* and the unthreaded lug 322*b*. Rotation of the clamp bolt 324 may tighten the open-ended clamp ring 320 around the perimeter of the container lid 302. The clamp bolt 324 may have a bolt head to be positioned proximal to the unthreaded lug 322*b*.

In some examples, the clamp bolt 324 may be pushed through or otherwise inserted through the unthreaded lug 322*b*. In some examples, the clamp bolt 324 may have a plurality of threads along a shaft and may be threaded with corresponding threads of the threaded lug 322*a*.

In some embodiments, the closure assembly may include a jam assembly for receiving the clamp bolt 324. In some embodiments, the jam assembly may include a pair of jam nuts 328 positioned between the threaded lug 322*a* and the unthreaded lug 322*b*.

The pair of jam nuts 328 may receive the clamp bolt 324. Once the clamp bolt 324 is rotated to tighten the clamp ring 320 around the perimeter of the container lid 302, the one or more jam nuts 328 may be adjacent to the unthreaded nut 322*b* to reduce movement of the clamp bolt relative to the unthreaded lug when the sealed container may be transported. Further details will be described with reference to FIGS. 4A and 4B.

In examples, such as those described with reference to FIG. 2, where the jam nut may be a single or sole lock nut, a technician may need to: (i) adjust the jam nut position along the clamp bolt (using a wrench); (ii) rotate the clamp bolt (using a socket); (iii) adjust the jam nut position along the clamp bolt; etc. in an iterative sequence until the clamp ring is tightened to a desired position. Such sequence of steps may make it challenging for the technician to secure the container lid to the container opening while keeping physical distance from the container opening. Such example operations may require a high degree of dexterity, and the technician may require both hands for performing such example operations.

Further, when the technician loosens the clamp ring from the perimeter of the container lid and removes the container lid from the container opening, the technician may need to physically hold the clamp ring 320 in a loosened or open position at least because the clamp ring may be biased towards a closed position. For example, when the unthreaded lug is unconstrained and when the jam nut may be positioned along the clamp bolt nearer to the threaded lug, the end of the clamp ring associated with the unthreaded lug may slide along the clamp bolt.

Accordingly, in some scenarios, it may be beneficial to provide closure assembly features to maintain the clamp ring in an open position during lid assembly removal (at least based on reducing movement of the clamp bolt relative to the unthreaded lug).

Figure 4A:
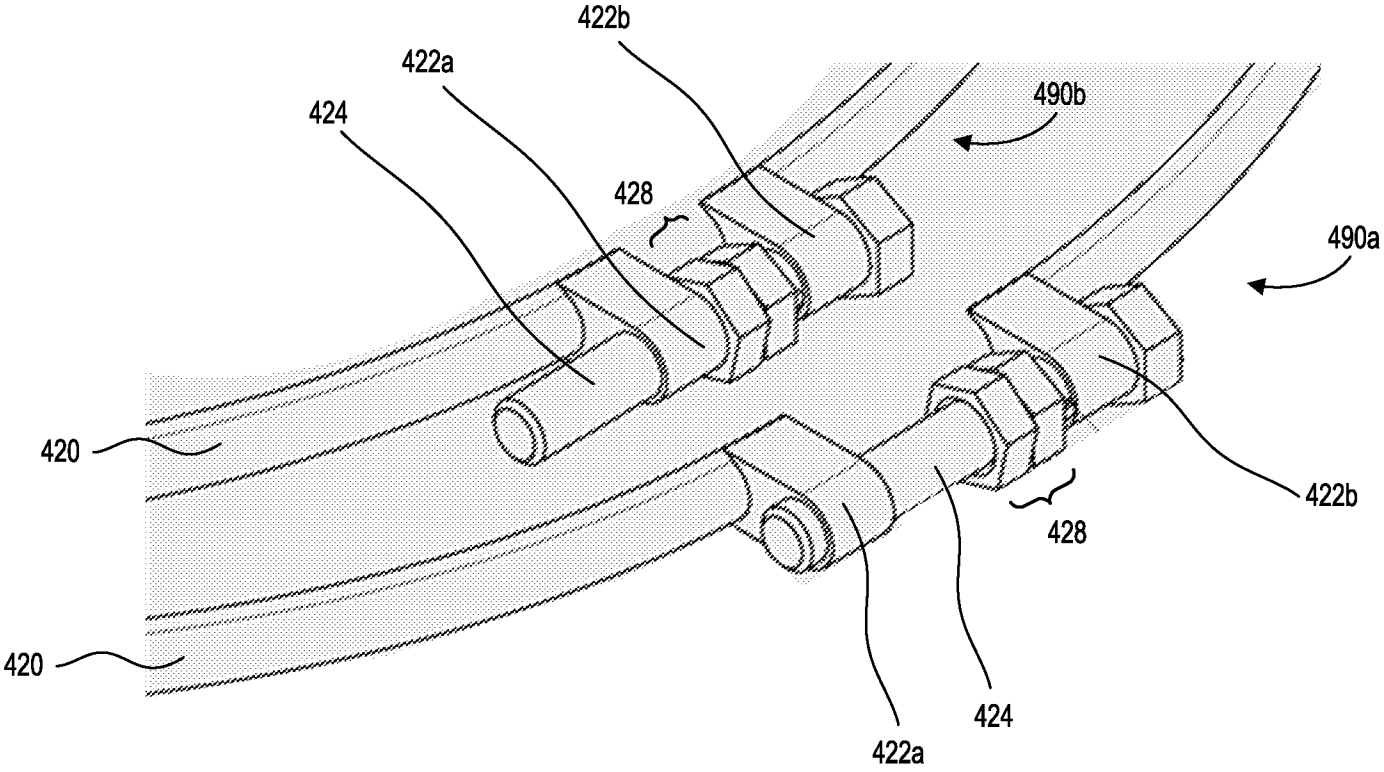
FIGS. 4A and 4B illustrate perspective views of closure assemblies coupled to an open-ended clamp ring in open positions and closed positions, in accordance with embodiments of the present disclosure.

Reference is made to FIG. 4A, which illustrates perspective views of a closure assembly coupled to an open-ended clamp band, in accordance with embodiments of the present disclosure. The open-ended clamp band may be a clamp ring 420. In FIG. 4, the clamp ring 420 is illustrated in an open position 490*a* and a closed position 490*b*. A diameter of the clamp ring 420 in a closed position may be smaller than a diameter of the clamp ring 420 in an open position. By decreasing the diameter of the clamp ring 420, the clamp ring 420 may be configured to secure a container lid to a container opening. By decreasing the diameter of the clamp ring 420, the distance between the threaded lug 422*a* and the unthreaded lug 422*b* is decreased.

In FIG. 4, the closure assembly includes a pair of lugs including a threaded lug 422*a* and an unthreaded lug 422*b*. The threaded lug 422*a* and the unthreaded lug 422*b* may be respectively affixed to opposing ends of the open-loop clamp band.

A threaded clamp bolt 424 may be receivable by the threaded lug 422*a* and the unthreaded lug 422*b*. When the clamp bolt 424 is rotated to tighten the clamp ring 420 around the perimeter of a container lid or about the opening of the container (not illustrated in FIG. 4), a bolt head of the clamp bolt 424 may advance towards the unthreaded lug 422*b* and impart a force to advance the unthreaded lug 422*b* towards the threaded lug 422*a* along a rotational axis of the threaded clamp bolt 424. Threads of the clamp bolt 424 may engage threads of the threaded lug 422*a*.

As described with reference to FIGS. 1 and 2, when a single jam nut is installed, a technician may need to conduct a sequence of operations to iteratively rotationally adjust the single jam nut and the clamp bolt when tightening the clamp ring to the perimeter of the container lid. Such operations may be required at least because: (i) the unthreaded lug may be biased against the single jam nut (e.g., the clamp ring may be biased towards a closed position); and/or (ii) the single jam nut may need to be rotated and advance along the clamp bolt to allow the threaded lug and the unthreaded lug to advanced towards one another.

To address one or more inefficiencies suggested with reference for example to FIGS. 1 and 2, the closure assembly in FIG. 4 may include a pair of jam nuts 428. In some embodiments, the respective jam nuts 428 may have a thinner dimension or profile than the jam nut 326 of FIG. 3, such that physical dimensions of the pair of jam nuts 428 do not impede the tightening of the clamp ring 420.

In some embodiments, the pair of jam nuts 428 may be configured at a calibrated position along the clamp bolt 424. Accordingly, when the jam nuts 429 are secured at the calibrated position along the clamp bolt 424, the pair of jam nuts 428 may be adjacent the threaded lug 422*a* when the clamp ring 420 is in a closed or tightened position about the perimeter of the container lid. The calibrated position may be predefined and may be a function of the diameter of the open-loop clamp band, the diameter of the container lid, or the diameter of the container opening.

To secure the pair of jam nuts 428 at the calibrated position along the clamp bolt 424, in some embodiments, each of the pair of jam nuts 428 may be positioned to abut the other of the pair of jam nuts 428 and torqued in a direction towards one another. As an example, each of the pair of jam nuts 428 may be rotationally torqued to the other of the pair of jam nuts 428 to approximately 70 ft/lbs of torque. Other torque amounts may be used.

Once the pair of jam nuts 428 have been rotationally torqued towards one another, the pair of jam nuts 428 may be in a fixed position along the clamp bolt 424. That is, the clamp bolt 424 and the pair of jam nuts 428 may be configured as if the components are collectively a unitary assembly.

Once in a closed position 490*b*, the pair of jam nuts may be positioned to be approximately adjacent both the threaded lug 422*a* and the unthreaded lug 422*b*, thereby restraining movement of the clamp bolt 424 relative to the unthreaded lug 422*b*. Further, as the pair of jam nuts 428 are positioned along the clamp bolt at a predisposed position (determined when the clamp ring is configured for the container), a technician conducting operations to tighten the clamp ring about the perimeter of the container lid may not need to adjust the pair of jam nuts whilst rotating the clamp bolt with a socket.

As described in the present disclosure, in some scenarios, it may be desirable to maintain the position of the clamp bolt 424 relative to the unthreaded lug 422*b*, such that the clamp ring 420 may be maintained in an open position for container lid removal or installation at the opening of the container.

In some other scenarios, although the jam nuts 428 may be secured along the clamp bolt at the calibrated position, the unthreaded lug 422*b* may not substantially occupy the gap or space between the jam nuts 428 and the bolt head. Because the unthreaded lug 422*b* may be unthreaded and may not securely engage with the clamp bolt 424, in some scenarios, the unthreaded lug 422*b* may slide within the space between the jam nuts 428 and the bolt head.

That is, scenarios where the unthreaded lug 422*b* may uncontrollably slide between the jam nuts 428 and the bolt head may lead to the clamp ring 420 not maintaining either an open position or a closed position. It may be beneficial to provide features for maintaining the unthreaded lug 422*b* at a position between the bolt head and the jam nuts 428, such that the clamp ring 420 may maintain a configured open position or closed position.

Figure 4B:
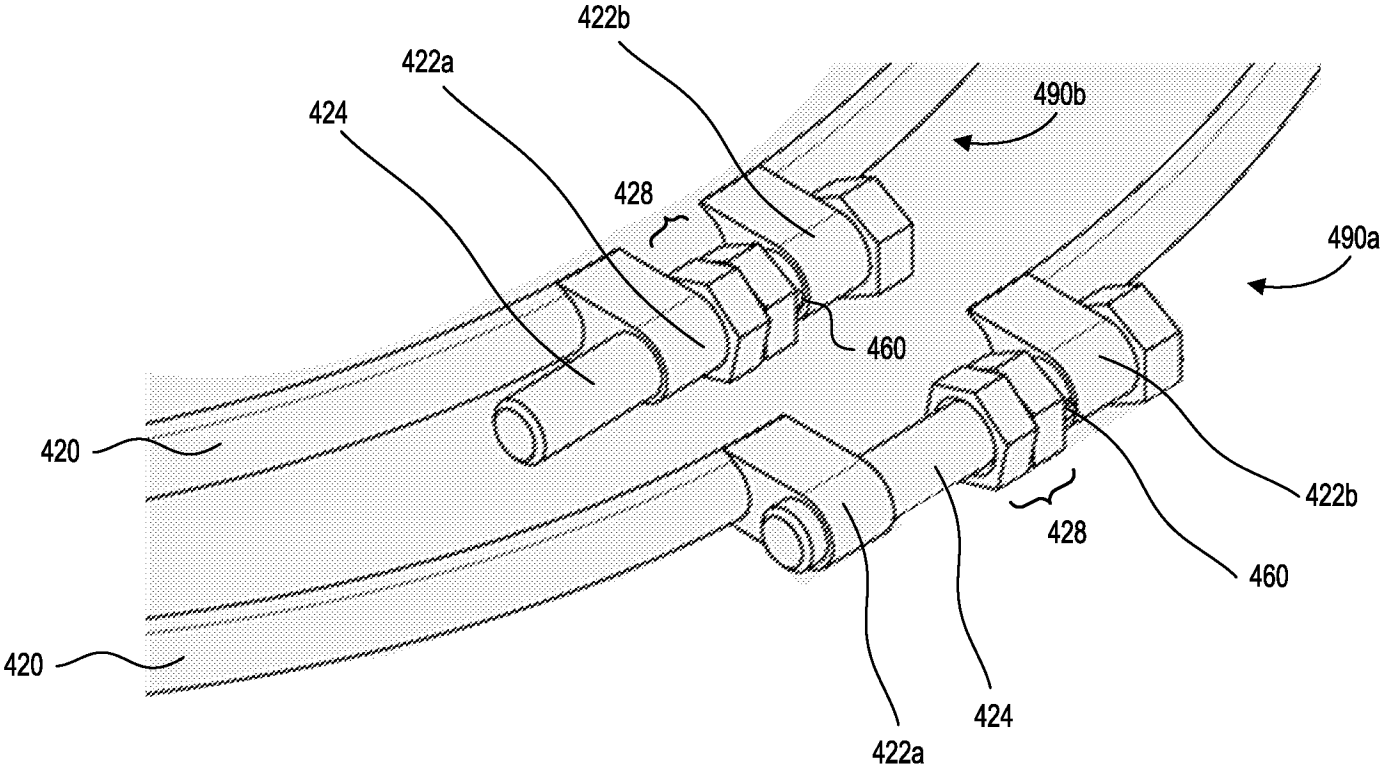

Reference is made to FIG. 4B, which illustrate perspective views of a closure assembly in an open position 490*a* and a closed position 490*b*. FIG. 4B is substantially similar to FIG. 4A, and additionally illustrates features to reduce movement of the clamp bolt 424 relative to the unthreaded lug 422*b*.

In FIG. 4B, the closure assembly may include a standoff device 460 positioned between the unthreaded lug 422*b* and the jam nuts 428 (e.g., jam assembly). The standoff device 4760 may be adapted to maintain a position of the unthreaded lug 422*b* relative to the bolt head. The standoff device 460 may be configured to restrict movement of the clamp bolt 424 relative to the unthreaded lug 422*b*. Restricting movement of the clamp bolt 424 relative to the unthreaded lug 422*b* may maintain the open-ended clamp ring 420 in an open position when the clamp bolt 424 is in an unfastened position (e.g., open position) relative to the threaded lug 422*a*.

In some embodiments, the standoff device 460 may include a pin received within an aperture in the shaft of the clamp bolt 424. The aperture may be positioned along the shaft to receive a pin, or the like, for maintaining abutment of the unthreaded lug 422*b* to the bolt head of the clamp bolt. The position of the aperture may be predetermined such that the clamp ring 420 may be in a loosened state when the closure assembly in an open position 490*a*. In some embodiments, the pin 460 may be a cotter pin, or similar engineering pin. The aperture may be positioned on an opposing side of the unthreaded lug 422*b* relative to the bolt head.

In some embodiments, the aperture may be a drilled hole in the shaft of the clamp bolt. In some situations, drilling the hole in the clamp bolt may not invalidate regulatory certification of the closure assembly.

Embodiments described with reference to the closure assembly in FIGS. 4A and 4B may allow a technician to remotely tighten the clamp ring 420 around the perimeter of the container lid and around the opening of the container at least because the pair of jam nuts 428 are torqued relative to one another. Accordingly, the clamp bolt 424 may be rotated as a unitary component, removing a requirement to additionally adjust or manipulate the pair of jam nuts 428. Thus, a technician may not need to stand physically adjacent the container opening to tighten the clamp ring 420 and may not need to conduct successive steps of adjusting the pair of jam nuts 428 and the clamp bolt 424 in an iterative sequence. As will be described, an arm assembly may be configured to position the lid assembly at the container opening, and an extended length socket wrench may be used to rotate the clamp bolt 424 to tighten the clamp ring 420 around the perimeter of the container lid. Because the lid assembly may be adjusted by an extended length socket wrench (e.g., rotating the combination of the clamp bolt and the jam assembly), it may not be necessary for a technician to be physically standing proximal to the container while a container lid is fastened to the container opening.

Further, embodiments described with reference to the closure assembly in FIG. 4B include features to maintain the clamp ring 420 in an open position 490*a*, such that a technician may not need to stand physically adjacent the container to hold the clamp ring 420 in an open position during removal or installation of the clamp ring 420/container lid. Reducing the requirement for technicians to physically manipulate the container lid or the closure assembly near the container opening reduces exposure risk of the technician to hazardous waste materials.

In some embodiments of the closure assembly, the combination of features described herein may allow the clamp ring to be held open during container lid and container handling operations.

As described herein, containers, container lids, or closure assemblies associated with storing and transporting hazardous materials may be subject to regulatory standards. Particular combinations of containers, container lids, and closure assemblies may be subject to certification testing. In some embodiments of the present disclosure, features of existing containers may be enhanced features described, for example, with reference to FIGS. 4A and 4B without invalidating prior certifications or test results. For example, replacing a single jam nut with a jam assembly (such as a pair of jam nuts respectively having a lower profile/thickness) between a threaded lug and an unthreaded lug of a closure assembly may not invalidate prior certifications of the container assembly, thereby minimizing costs to provide improved container assemblies. Further, introducing a standoff device between the one or more jam nuts and the unthreaded lug may not invalidate prior certifications of the container assembly.

In some scenarios, containers for receiving or storing hazardous substances (e.g., ionizing radioactive materials, among other example materials) may be handled and transported within an environment employing protective barriers to reduce exposure to machine operators or technicians. In some embodiments, protective barriers may be configured to contain gaseous materials, aerosols, or airborne particles.

In some embodiments, biological shielding barriers may be configured to reduce or contain ionizing radiation. Some environments for handling containers may include at least two regions: (a) a shield enclosure area for handling materials exhibiting ionizing gamma radiation; and (b) a confinement area for handling materials exhibiting airborne radioactive alpha particles.

In some embodiments, prior to introducing container assemblies to environments for handling hazardous materials, container assemblies may be prepared based on one or more of the following operations: (a) modifying an existing clamp bolt to provide an aperture, at a predetermined or calibrated location relative to a bolt head, by drilling into the shaft of the clamp bolt; (b) replacing existing single jam nuts with a pair of jam nuts to be received on the threaded clamp bolt; (c) torqueing each of the pair of jam nuts towards the other of the pair of jam nuts to effectively lock or secure the pair of jam nuts at a predetermined (e.g., calibrated) position about the clamp bolt, such that the clamp bolt and the pair of jam nuts may rotate as a unitary assembly; (d) inserting a pin within the drilled aperture, such that the pin protrudes from each side of the through-hole aperture, to maintain the clamp bolt position relative to the unthreaded lug; (e) removing the clamp ring (while in open position) for ensuring that the clamp ring is sufficiently loosened to be lifted clear of the container opening during hazardous waste handling; or (f) placement of the annular weight adjacent the outer surface of the container lid, such that the annular weight may maintain the circumferential shape of the clamp ring (e.g., within a single plane).

Figure 5:
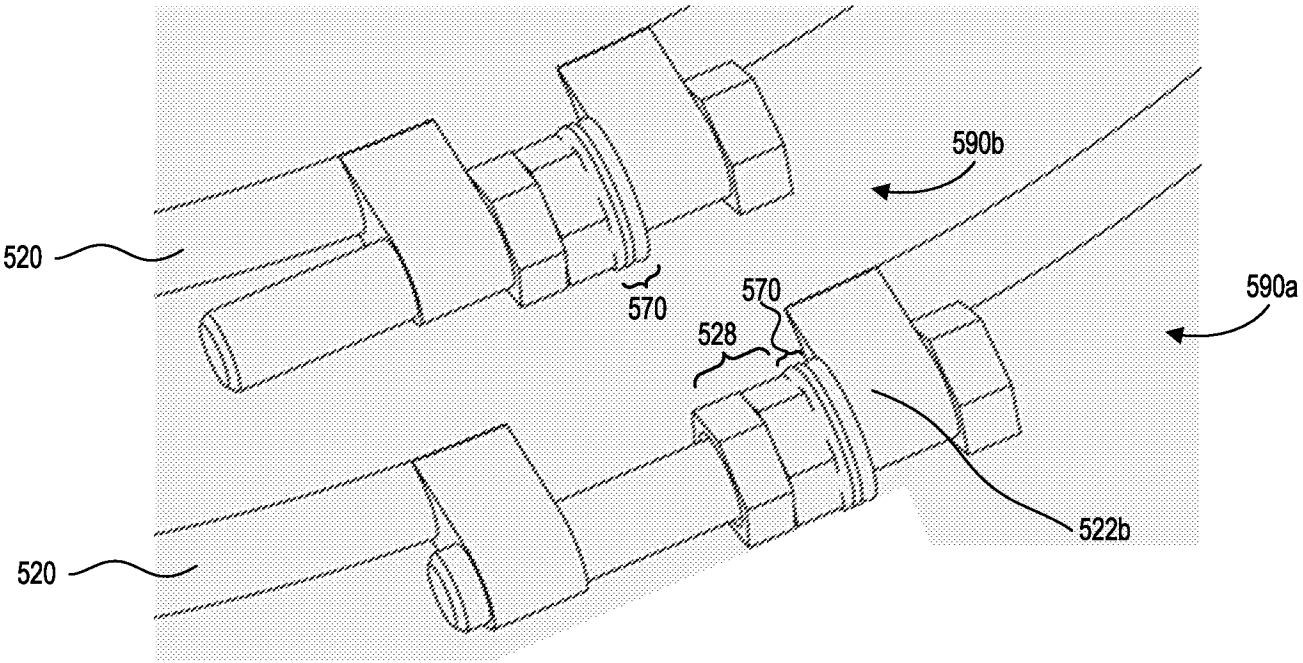
FIG. 5 illustrates perspective views of a closure assembly coupled to an open-ended clamp ring in an open position and a closed position, in accordance with embodiments of the present disclosure.

Reference is made to FIG. 5, which illustrates perspective views of a closure assembly coupled to an open-loop clamp band 520 in an open position 590*a* and a closed position 590*b*, in accordance with embodiments of the present disclosure.

The closure assembly illustrated in FIG. 5 includes features similar to the closure assembly described with reference to FIG. 4A or 4B. Further, the closure assembly illustrated in FIG. 5 includes a standoff device including one or more Belleville washers 570. The Belleville washers 570 may be positioned between the unthreaded lug 522*b* and a pair of jam nuts 528. Movement of the clamp bolt relative to the unthreaded lug 522*b* may be minimized, and the clamp ring 520 may be held open during installation or removal of a container lid.

Figure 6:
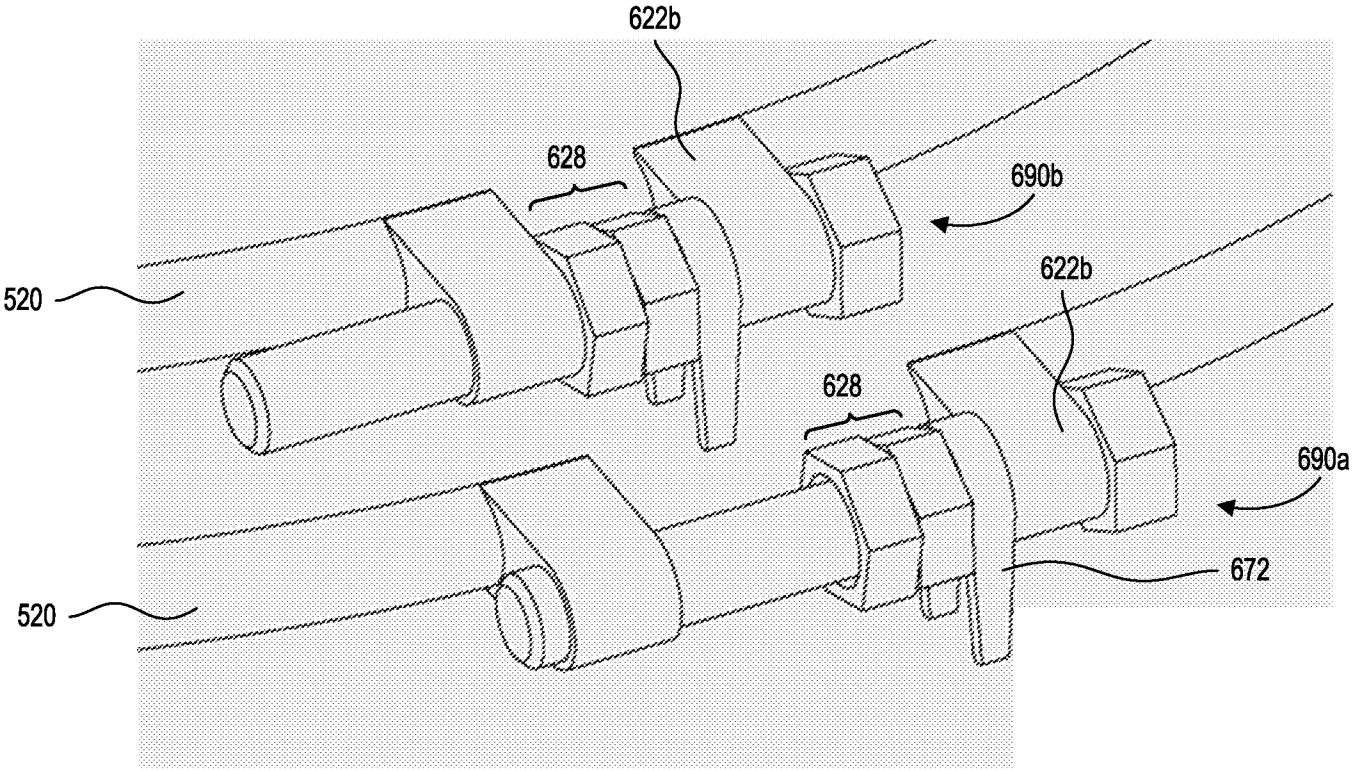
FIG. 6 illustrates perspective views of a closure assembly coupled to an open-ended clamp ring in an open position and a closed position, in accordance with embodiments of the present disclosure.

Reference is made to FIG. 6, which illustrates perspective views of a closure assembly coupled to an open-ended clamp ring 620 in an open position 590*a* and a closed position 590*b*, in accordance with embodiments of the present disclosure.

The closure assembly illustrated in FIG. 6 includes features similar to the closure assembly described with reference to FIG. 4A or 4B. Further, the closure assembly illustrated in FIG. 6 includes a standoff device including a wedge 672. The wedge 672 may be positioned between the unthreaded lug 622*b* and a pair of jam nuts 628, such that movement of the clamp bolt relative to the unthreaded lug 622*b* may be minimized, and the clamp ring 620 may be held open during installation or removal of a container lid.

Figure 7:
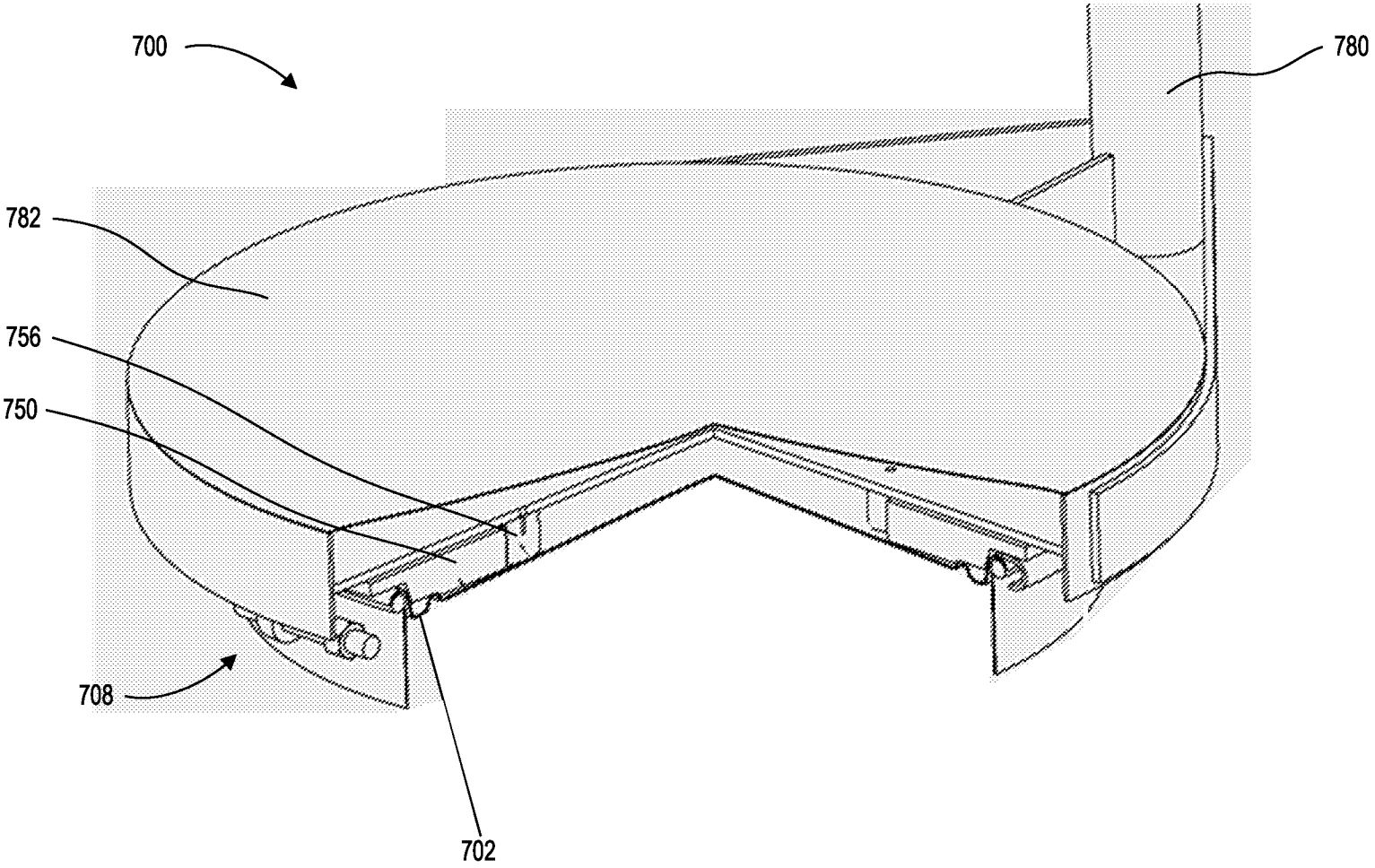
FIG. 7 illustrates a lid apparatus, in accordance with an embodiment of the present disclosure.

Reference is made to FIG. 7, which illustrates a lid apparatus 700, in accordance with an embodiment of the present disclosure. The lid apparatus 700 may be configured to operate with a container lid or a lid assembly (e.g., lid assembly 300 of FIG. 3) for placing and packaging hazardous wastes within containers, such as cylindrical drums.

In some embodiments, remotely operated environments may include apparatus configured to convey drums to one or more positions within the hazardous waste packaging environment. The apparatus may include arm assemblies that may couple to lid assemblies and that may install or remove lid assemblies onto or from drums.

In FIG. 7, the apparatus 700 may include an arm assembly having a rotating shaft 780 configured to couple to a lid removal apparatus 700. The rotating shaft may be configured to pivot the lid apparatus 700 to or from an opening of a container or drum. In some embodiments, the apparatus may include features to convey the container to a location proximal to the arm assembly, and the arm assembly may be configured to conduct micro-adjustments to a position of the container lid 702 relative to the target container prior to installing the container lid 702 at the opening of the target container.

In some embodiments, the apparatus may be configured to convey the container to a location proximal to the arm assembly and may be configured to rotate, via a configurable turntable, the drum to orient the drum in position for lid assembly or lid removal operations.

A lid assembly may include the container lid 702 and an annular weight 750 adapted to overlay a region proximal to a perimeter of the container lid 702. In some embodiments, when placed atop the container lid 702, the container lid 702 and the annular weight 750 may be positioned to be concentric one another, thereby having aligned center points.

The lid assembly may include a clamp band or clamp ring (not explicitly illustrated in FIG. 7) and a closure assembly 708 coupled to the clamp ring. The closure assembly may include one or more features described in embodiments of the present disclosure.

The apparatus 700 may include one or more electromagnets 756 that may be coupled to the arm assembly. In examples where the container lid 702 may be constructed of steel or magnetic material, when the one or more electromagnets 756 are energized, the electromagnets 756 may be configured to couple to the container lid 702. The apparatus 700 may be configured to pivot the container lid 702 to the container opening for installation and for sealing thereto.

In some embodiments, the one or more electromagnets 756 may include an independent uninterruptable power supply configured to prevent inadvertent de-energizing of the electromagnets 756 that may lead to inadvertent release of container lids into the environment. In the above-described example, the one or more electromagnets 756 may temporarily couple to container lids 702 constructed of magnetic material. When the container lid 702 is positioned and placed at the container opening, the one or more electromagnets 756 may be de-energized.

In some embodiments, the lid removal assembly 700 may include one or more configurable suction cups for picking up the container lid 702. In scenarios where the container lids 702 may be constructed of non-metallic material (or in scenarios where it may be beneficial to utilize suction cup devices), the assembly 700 may include one or more configurable suction cups for picking up the container lid 702.

In some scenarios, hazardous waste materials may be conveyed to the container via an overhead filing port that may be positioned above the container opening. The filling port may be configured to dispense materials into the container. When the filling ports cease dispensing waste, the assembly 700 may pivot a drip tray 782 to a position adjacent the container opening to receive excess or residual material that may drip from the filling port.

In some embodiments, the drip tray 782 may have a shape similar to the annular weight 750 or the container lid 702. By receiving the excess or residual material from the filling port, the drip tray 782 may be configured to prevent residual material from contaminating an exterior surface of the container or of the container lid 702.

In some embodiments, the drip tray and the annular weight may be configured to be substantially concentric with one another. For example, the drip tray and the annular weight may be substantially circular in shape, and the drip tray and the annular weight may be positioned such that a center point of the drip tray and a center point of the annular weight may be aligned.

In some examples, the drip tray 782 may have a shape or size substantially similar to the shape or size of the annular weight 750 or the container lid 702.

In some embodiments, the annular weight 750 may be a ring-shaped weight having a hollow central region. In some embodiments, the drip tray 782 may be adapted to be substantially positioned within the hollow central region of the annular weight 750.

In some situations, solid wastes contained in smaller containers, bags, or other bundled debris may be placed within containers being sealed with embodiment apparatus described in the present disclosure.

In some embodiments, when the annular weight is positioned atop a container lid, the annular weight may apply a sealing force at an interface between the container lid and the container opening. Subsequently, the container lid may be fitted at the container opening, and a socket tool may be extended to a closure assembly. The socket tool may rotate a clamp bolt of the closure assembly 708 for tightening the clamp ring around: (i) the perimeter of the container lid; and (ii) the upper rim of the container opening.

In some embodiments, the container filled with waste materials may be rotated on a turntable to align the clamp bolt of the closure assembly to a socket extending to the clamp bolt, where the socket tool may rotate the clamp bolt. The clamp bolt may be rotated to a predetermined torque for tightening the clamp ring around the perimeter of the container lid.

In some situations, the annular weight may be removed from the container lid once the container lid is secured to the container opening.

Figure 8:
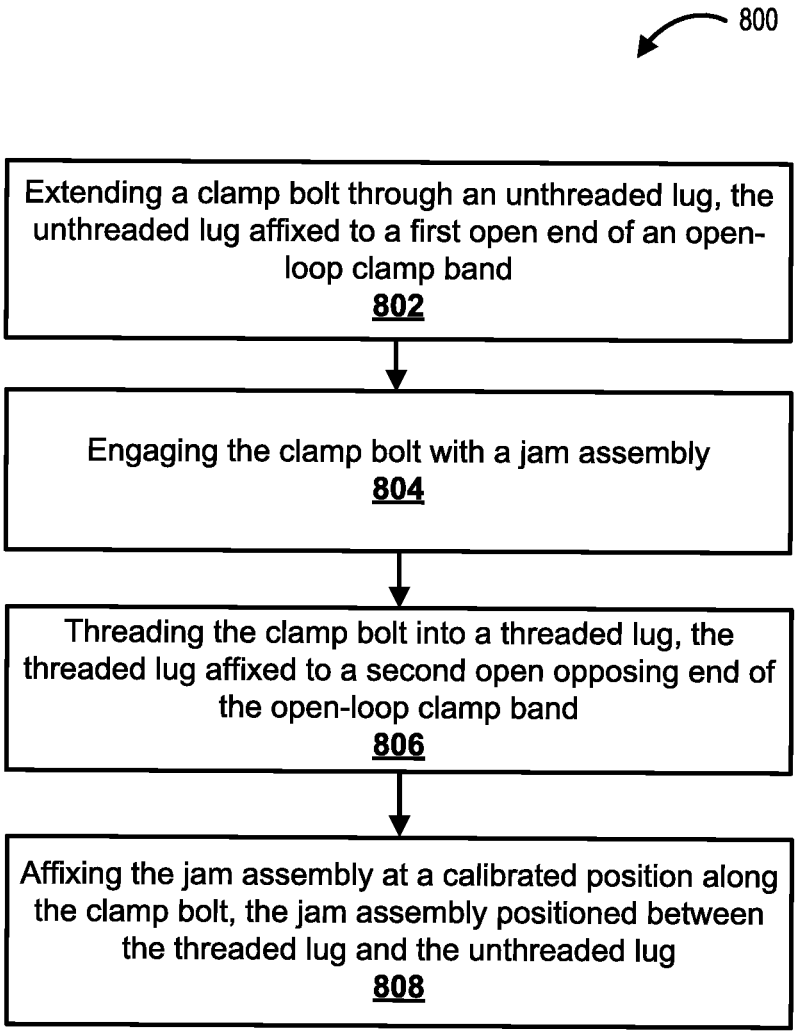
FIG. 8 illustrates a method of assembling a lid assembly for a container lid, in accordance with embodiments of the present disclosure.

Reference is made to FIG. 8, which illustrates a method 800 of assembling a lid assembly for a container lid, in accordance with embodiments of the present disclosure. The lid assembly may include features described in the present disclosure, such as features described with reference to FIGS. 3 to 7. In some embodiments, the operations of the method 800 may be conducted by a technician assembling embodiments of lid assemblies described in the present disclosure. In some embodiments, the operations of the method 800 may be conducted at least in part based on operations of an assembly apparatus.

For ease of exposition, reference will be made to FIG. 4B while describing operations of the method 800 of FIG. 8. In some embodiments, operations may include a series of operations including inserting a clamp bolt 424 through an unthreaded lug 422*b*, engaging the clamp bolt 424 with a jam assembly, and threading the clamp bolt into the threaded lug 422*a*, such that a bolt head of the clamp bolt 424 may be positioned proximal the unthreaded lug 422*b*. To illustrate some embodiments, reference is made to the method 800 of FIG. 8.

At 802, operations include extending a clamp bolt 424 through an unthreaded lug 422*b*. The unthreaded lug 422*b* may be affixed to a first open end of an open-loop clamp band, such as the clamp ring 420. In some embodiments, the clamp bolt 424 may have threads along its shaft. As the unthreaded lug 422*b* may be devoid of threads, extending the clamp bolt 424 through the unthreaded lug 422*b* may include pushing the clamp bolt 424 through the unthreaded lug 422*b*. It may not be necessary to rotate the clamp bolt 424 to extend the clamp bolt 424 into the unthreaded lug 422*b*.

At 804, operations include engaging the clamp bolt 424 with a jam assembly. In some embodiments, the jam assembly includes a pair of jam nuts 428. The pair of jam nuts 428 may be engaged with the clamp bolt 424 by threading the clamp bolt 424 with the pair of jam nuts 428. As described in the present disclosure, the jam assembly may be securable along the clamp bolt and between the threaded lug 422*a* and the unthreaded lug 422*b*.

At 806, operations include threading the clamp bolt 424 into a threaded lug 422*a*. The threaded lug 422*a* may be affixed to a second open end of the clamp ring 420. Depending on the direction of rotation of the clamp bolt 424, the clamp ring 420 may transition from an open position to a closed position for securing a container lid at a container opening, or may transition from a closed position to an open position to allow removal of the container lid from the container opening.

At 808, operations include affixing the jam assembly at a calibrated position along the clamp bolt 424. The jam assembly may be positioned between the threaded lug 422*a* and the unthreaded lug 422*b*.

In some embodiments, affixing the jam assembly may include torqueing each of the jam nuts towards the other of the pair of jam nuts to secure the jam assembly at the calibrated position along the clamp bolt. By engaging the clamp bolt 424 with the jam assembly, the clamp bolt 424 and the pair of nuts 428 may rotate as a unitary structure when the clamp bolt 424 is rotated for transitioning between an open position and a closed position of the open-loop clamp band.

Because the jam assembly may be secured to the clamp bolt 424, such that the clamp bolt 424 and the jam assembly may be a unitary structure, rotation of the jam assembly (e.g., the pair of jam nuts secured at the calibrated position along the clamp bolt 424) by a technician during operations to transition the clamp ring 420 from the open position to the closed position may not be necessary. This may be contrasted with the example illustrated in FIG. 2. Recall that in FIG. 2, the sole lock nut 126 may not be secured at any particular position along the clamp bolt 124. To transition the clamp ring from an open position to the closed position, a technician may need to conduct a series of operations of rotating the lock nut 126 and the clamp bolt 124 in an iterative sequence. Because the clamp ring 120 may be biased towards a closed position, the unthreaded lug 122*b* may be biased against the sole lock nut 126.

In some embodiments, the calibrated position along the clamp bolt 424 may be predefined or otherwise identified as a position when the jam nuts 428 may be adjacent the threaded lug 422*a* while the open-loop clamp band is in a closed position. The calibrated position along the clamp bolt 424 may be a function of the diameter of the open-loop clamp band, the diameter of the container lid, or the diameter of the container opening.

Embodiments of jam assemblies described in the present disclosure include a pair of nuts respectively torqued towards one another. Upon respectively torqueing the pair of nuts towards one another, the pair of nuts may be secured to that position along the clamp bolt 424. As the pair of nuts 428 of FIG. 4 may respectively have a thickness profile that is thinner than a thickness profile of a sole lock nut 126 of FIG. 1, embodiments including the pair of nuts 428 secured along the clamp bolt 424 result in features that may not invalidate prior-certification tests or regulatory approvals for containers, container lids, or lid assemblies associated with sealing such containers.

In some embodiments, operations may include securing a standoff device between the unthreaded lug 422*b* and the jam assembly to maintain a position of the bolt head relative to the unthreaded lug 422*b*. In some embodiments, the standoff device may be a cotter pin 460 (FIG. 4B), a Bellville washer 570 (FIG. 5), or a wedge 672 (FIG. 6), among other examples.

In some embodiments, securing the standoff device may include drilling an aperture in a shaft of the clamp bolt at a position between the affixed jam assembly (e.g., a pair of secured nuts 428) and the unthreaded lug 422*b*. Operations for securing the standoff device may include inserting a cotter pin 460 within the drilled aperture for positioning the pin between the jam assembly and the unthreaded lug.

In some embodiments, the method 800 may include operations to rotate the clamp bolt 424 in a direction to unthread the clamp bolt 424 from the threaded lug 422*a*, so as to position the open-loop clamp band in an open position. By assembling the lid assembly (e.g., method 800) such that the open-loop clamp band is in an open position, the clamp band may be provided to a container sealing station, and the open-loop clamp band may be readily available for positioning at an interface between a container lid and a rim of the container opening.

The term "connected" or "coupled to" may include both direct coupling (in which two elements that are coupled to each other contact each other) and indirect coupling (in which at least one additional element is located between the two elements).

Although the embodiments have been described in detail, it should be understood that various changes, substitutions and alterations can be made herein without departing from the scope. Moreover, the scope of the present disclosure is not intended to be limited to the particular embodiments of the process, machine, manufacture, composition of matter, means, methods and steps described in the specification.

As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

The description provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As can be understood, the examples described above and illustrated are intended to be exemplary only.

Applicant notes that the described embodiments and examples are illustrative and non-limiting. Practical implementation of the features may incorporate a combination of some or all of the aspects, and features described herein should not be taken as indications of future or existing product plans.

What is claimed is:

1. An apparatus for sealing a container lid to a container containing nuclear waste and/or toxic material, the apparatus comprising:

a lid assembly comprising:

an open-loop clamp band configured to secure the container lid to a container opening, the open-loop clamp band biased towards a closed position; and a closure assembly coupled to the open-loop clamp band, the closure assembly including:

a pair of lugs including a threaded lug and an unthreaded lug respectively affixed to opposing ends of the open-loop clamp band;

a clamp bolt receivable by the pair of lugs, the clamp bolt having a bolt head to be positioned proximal the unthreaded lug; and a jam assembly for receiving the clamp bolt, the jam assembly being positioned at a predetermined calibrated position along the clamp bolt relative to the bolt head and between the pair of lugs, an annular weight for overlaying a region proximal to a perimeter of the container lid to impart a downward sealing force at an interface between the container lid and the container opening, wherein the downward force at the interface seals a gap defined by the container lid and the container; and a drip tray configured to be positioned on a surface of the container lid for receiving excess substance from a container fill head, wherein the surface opposes a side of the container lid configured to seal the container opening, wherein the annular weight is a ring-shaped weight having a hollow central region, and wherein the drip tray is positioned within the hollow central region of the annular weight.

2. The apparatus of claim 1, wherein:

the jam assembly includes a pair of jam nuts, and wherein a first jam nut of the pair of jam nuts is torqued toward a second jam nut of the pair of jam nuts, and the second jam nut is torqued toward the first jam nut, the pair of jam nuts and clamp bolt being rotatable as a unitary assembly, the predetermined calibrated position is a position of the pair of jam nuts when the pair of jam nuts are adjacent the threaded lug when the open-loop clamp band is in a closed or tightened position about the perimeter of the container lid, wherein the open-loop clamp band is configured to move to the closed or tightened position when the clamp bolt is tightened while maintaining the jam assembly at the predetermined calibrated position along the clamp bolt, the clamp bolt is rotatable for transitioning the open-loop clamp band between an open position and the closed position.

3. The apparatus of claim 1, wherein the open-loop clamp band is a clamp ring for fitting around a substantially circular drum lid.

4. The apparatus of claim 1, comprising a standoff device for positioning between the unthreaded lug and the jam assembly for maintaining a position of the bolt head relative to the unthreaded lug.

5. The apparatus of claim 4, wherein the standoff device includes a pin received within an aperture in a shaft of the clamp bolt, the aperture positioned on an opposing side of the unthreaded lug relative to the bolt head.

6. The apparatus of claim 4, wherein the standoff device includes at least one of a Belleville washer or a wedge device.

7. The apparatus of claim 1, wherein the annular weight includes an electromagnet configured to engage the container lid for placing or removing the container lid at the container opening.

8. The apparatus of claim 1, wherein the drip tray and the annular weight are configured to be substantially concentric with one another.

9. An apparatus for sealing a container lid to a container, the apparatus comprising:

a lid assembly comprising:

an open-loop clamp band configured to secure the container lid to a container opening; and a closure assembly coupled to the open-loop clamp band;

an annular weight for overlaying a region proximal to a perimeter of the container lid to impart a downward sealing force at an interface between the container lid and the container opening, wherein the downward force at the interface seals a gap defined by the container lid and the container; and a drip tray positioned on a surface of container lid for receiving excess substance from a container fill head, wherein the drip tray and the annular weight are configured to be positioned concentric with the annular weight.

10. The apparatus of claim 9, wherein the annular weight includes a plurality of wedge-shaped alignment fingers configured to concentrically align the annular weight with the container lid.

11. The apparatus of claim 9, wherein the closure assembly includes:

a pair of lugs including a threaded lug and an unthreaded lug respectively affixed to opposing ends of the open-loop clamp band;

a clamp bolt receivable by the pair of lugs, the clamp bolt having a bolt head to be positioned proximal the unthreaded lug; and a jam assembly for receiving the clamp bolt, the jam assembly securable at a calibrated position along the clamp bolt and between the pair of lugs, wherein the clamp bolt is rotatable for transitioning the open-loop clamp band between an open position and the closed position.

12. The apparatus of claim 11, wherein the jam assembly includes a pair of jam nuts respectively torqued towards the other of the pair of jam nuts to secure the jam assembly at the calibrated position along the clamp bolt, wherein a first jam nut of the pair of jam nuts is torqued toward a second jam nut of the pair of jam nuts, and the second jam nut torqued toward the first jam nut, the pair of jam nuts and clamp bolt rotatable as a unitary assembly, and wherein the calibrated position is determined based on a position of the pair of jam nuts when the pair of jam nuts are adjacent the threaded lug when the open-loop clamp band is in a closed or tightened position about the perimeter of the container lid.

13. The apparatus of claim 11, comprising a standoff device for positioning between the unthreaded lug and the jam assembly for maintaining a position of the bolt head relative to the unthreaded lug while the open-loop clamp band is biased towards the closed position, wherein the standoff device includes a pin received within an aperture in a shaft of the clamp bolt, the aperture positioned on an opposing side of the unthreaded lug relative to the bolt head.

14. A method of assembling a lid assembly for a container lid, the method comprising:

extending a clamp bolt through an unthreaded lug, the unthreaded lug affixed to a first open end of an open-loop clamp band;

engaging the clamp bolt with a jam assembly;

threading the clamp bolt into a threaded lug, the threaded lug affixed to a second open end of the open-loop clamp band;

affixing the jam assembly at a calibrated position along the clamp bolt relative to the bolt head, the jam assembly positioned between the threaded lug and the unthreaded lug, coupling an annular weight to the container lid, the annular weight positioned to overlay a region proximal to a perimeter of the container lid to impart a downward sealing force at an interface between the container lid and a container opening of the container, wherein the downward force at the interface seals a gap defined by the container lid and the container, wherein the annular weight is a ring-shaped weight having a hollow central region; and coupling a drip tray to the container lid, the drip tray configured to be positioned on a surface of the container lid for receiving excess substance from a container fill head, wherein the surface opposes a side of the container lid configured to seal the container opening, wherein the drip tray is positioned within the hollow central region of the annular weight.

15. The method of claim 14, comprising securing a standoff device between the unthreaded lug and the jam assembly to maintain a position of the bolt head relative to the unthreaded lug.

16. The method of claim 15, wherein the standoff device includes a pin, and wherein securing the standoff device includes:

drilling an aperture in a shaft of the clamp bolt at a position between the affixed jam assembly and the unthreaded lug; and inserting the pin within the drilled aperture for positioning the pin between the jam assembly and the unthreaded lug.

17. The method of claim 14, comprising rotating the clamp bolt head in a direction to unthread the clamp bolt from the threaded lug to position the open-loop clamp band in an open position.

18. The method of claim 14, comprising rotating the clamp bolt head in a direction to thread the clamp bolt into the threaded lug to position the open-loop claim band in the closed or tightened position to seal the container lid to a container containing nuclear and/or toxic waste, wherein the jam assembly is maintained at the calibrated position while the clamp bolt head is rotated.

* * * * *